US007955180B2

(12) United States Patent
Bittner

(10) Patent No.: US 7,955,180 B2
(45) Date of Patent: Jun. 7, 2011

(54) GOLF PUTTER WITH AIMING APPARATUS

(76) Inventor: Norman Douglas Bittner, St. Helena Island, SC (US)

( * ) Notice: Subject to any disclaimer, the term of this patent is extended or adjusted under 35 U.S.C. 154(b) by 0 days.

(21) Appl. No.: 12/475,394

(22) Filed: May 29, 2009

(65) Prior Publication Data

US 2010/0304879 A1 Dec. 2, 2010

(51) Int. Cl.
*A63B 69/36* (2006.01)
*A63B 53/04* (2006.01)

(52) U.S. Cl. ..... 473/242; 473/251; 473/252; 473/340

(58) Field of Classification Search ..... 473/251–255; D21/736–746
See application file for complete search history.

(56) References Cited

U.S. PATENT DOCUMENTS 1,291,967 A * 1/1919 Mcdougal ..... 473/251
2,503,506 A * 4/1950 Miller ..... 473/251
D205,041 S * 6/1966 Capps ..... D21/759
D209,149 S * 11/1967 Sowers ..... D21/746
3,880,430 A * 4/1975 McCabe ..... 473/253
D235,568 S * 6/1975 Cook ..... D21/739
3,945,646 A 3/1976 Hammond
3,954,265 A * 5/1976 Taylor ..... 473/252
4,137,566 A 1/1979 Haas et al.
4,155,555 A 5/1979 Fink
4,209,172 A * 6/1980 Yamamoto ..... 473/200
D256,262 S * 8/1980 Benson ..... D21/745
4,251,077 A 2/1981 Pelz et al.
4,254,956 A 3/1981 Rusnak
4,304,406 A 12/1981 Cromarty
4,341,384 A 7/1982 Thackrey
4,615,526 A 10/1986 Yasuda et al.
4,741,535 A * 5/1988 Leonhardt ..... 473/252
4,834,387 A * 5/1989 Waites et al. ..... 473/252
4,858,934 A 8/1989 Ladick et al.
D308,238 S * 5/1990 Francu ..... D21/743
4,958,836 A 9/1990 Onozuka et al.
4,962,931 A * 10/1990 Jazdzyk, Jr. ..... 473/252
4,971,325 A 11/1990 Lipps
4,979,745 A 12/1990 Kobayashi
4,988,107 A * 1/1991 Sasse ..... 473/254
5,419,562 A 5/1995 Cromarty
5,435,547 A 7/1995 Lee
5,501,463 A 3/1996 Gobush et al.
5,533,728 A * 7/1996 Pehoski et al. ..... 473/252
5,564,990 A * 10/1996 Weeks ..... 473/251
D377,675 S * 1/1997 Abel ..... D21/745
5,614,823 A 3/1997 Katayama et al.
5,638,300 A 6/1997 Johnson
5,676,603 A * 10/1997 Miller ..... 473/220
5,685,782 A 11/1997 Lipps et al.
5,907,819 A 5/1999 Johnson
D420,411 S * 2/2000 Hettinger ..... D21/744
D429,297 S * 8/2000 Hettinger ..... D21/744
6,095,928 A 8/2000 Goszyk (Continued)

*Primary Examiner* — Sebastiano Passaniti
(74) *Attorney, Agent, or Firm* — Nixon & Vanderhye P.C.

(57) ABSTRACT

The present invention relates to an improved golf club with line markings on the head of the putter that facilitate a precise and accurate motion of the club. One of these markings, the aiming line, runs parallel to the club face across the top of the club and is intended to assist the golfer in aiming and placement of the club head. The other markings, the guide lines, run perpendicular to the club face across the top of the club and are intended to guide the path of the subsequent motion of the club to hit a golf ball.

5 Claims, 3 Drawing Sheets

U.S. PATENT DOCUMENTS

| | | | | |
|---|---|---|---|---|
| D434,094 | S * | 11/2000 | Miyashita | D21/744 |
| 6,287,215 | B1 | 9/2001 | Fisher | |
| 6,375,579 | B1 | 4/2002 | Hart | |
| 6,551,195 | B2 * | 4/2003 | Byrne et al. | 473/200 |
| D481,431 | S * | 10/2003 | Wightman | D21/743 |
| 6,716,110 | B1 * | 4/2004 | Ballow | 473/242 |
| 6,739,981 | B1 | 5/2004 | Lin | |
| 6,988,955 | B2 * | 1/2006 | Stoakes | 473/242 |
| 7,001,284 | B2 * | 2/2006 | Edel | 473/252 |
| D520,088 | S * | 5/2006 | Parr | D21/744 |
| D523,102 | S * | 6/2006 | Stites et al. | D21/742 |
| 7,101,288 | B2 * | 9/2006 | Thomas | 473/242 |
| 7,182,697 | B2 * | 2/2007 | Zamora | 473/251 |
| 7,232,375 | B1 | 6/2007 | Robert et al. | |
| D548,296 | S * | 8/2007 | Rollinson | D21/744 |
| D559,930 | S * | 1/2008 | Cameron | D21/746 |
| 7,371,184 | B2 * | 5/2008 | Tao | 473/242 |
| 7,393,285 | B2 * | 7/2008 | Stellander | 473/251 |
| D585,511 | S * | 1/2009 | Cameron | D21/743 |
| D590,035 | S * | 4/2009 | Hilton | D21/744 |
| 7,601,073 | B2 * | 10/2009 | Henry | 473/249 |
| D620,993 | S * | 8/2010 | Laub | D21/746 |
| 2001/0005695 | A1 | 6/2001 | Lee et al. | |
| 2002/0077189 | A1 | 6/2002 | Tuer et al. | |
| 2005/0037854 | A1 * | 2/2005 | Green | 473/226 |
| 2005/0187028 | A1 * | 8/2005 | Chang et al. | 473/231 |
| 2005/0192114 | A1 * | 9/2005 | Zider et al. | 473/251 |
| 2005/0197198 | A1 | 9/2005 | Otten et al. | |
| 2006/0029916 | A1 | 2/2006 | Boscha | |
| 2007/0249428 | A1 | 10/2007 | Pendleton et al. | |
| 2009/0017933 | A1 * | 1/2009 | Stites et al. | 473/254 |
| 2009/0054172 | A1 * | 2/2009 | Meehan | 473/251 |

* cited by examiner

GOLF PUTTER WITH AIMING APPARATUS

CROSS-REFERENCE TO RELATED APPLICATIONS

N/A

STATEMENT REGARDING FEDERALLY SPONSORED RESEARCH OR DEVELOPMENT

N/A

THE NAMES OF THE PARTIES TO A JOINT RESEARCH AGREEMENT

N/A

REFERENCE TO A "SEQUENCE LISTING"

N/A

BACKGROUND OF THE INVENTION (1) Field of the Invention

The present invention relates to golf clubs and, more specifically, to a putter with a novel arrangement of visual guides.

(2) Description of Related Art Including Information Disclosed Under 37 CFR 1.97 and 37 CFR 1.98

The traditional "pendulum swing" of a putter, used by most modern golfers, has too many random variables such as the height of the swing, distance of the backswing, speed of the club head on return to the ball for the strike, direction of the aim of club head direction, and rotation of the club head for the mind and muscles to be adequately trained for a consistently successful putt. The traditional pendulum swing is confronted with infinite variables for every putting event and is not recordable and correctable with a device of sufficient capacity that enables making corrections in the putting event. The "pendulum swing" faces its own unique direction, undulation and speed requirements with little opportunity for correction.

In contrast to the "pendulum swing", a "piston motion" reduces the number of variables effecting putting to a more manageable replication, making it possible to "burn" into one's muscle memory a consistent pattern and result. There are new visual, postural and muscle memory events in the "piston motion" technique that are in conflict with traditional approaches to putting—for instance, the stroke contacts the ball at the end of a motion that is as nearly perfectly straight in 3 dimensions as possible. There is no rotation of the club head. There is little or no elevation of the club head off the putting surface that is sufficient for clearance from the ground to generate a smooth path.

Application Ser. No. 12/268,231 (Bittner) describes a specialized putter, grid, and system designed to train a golfer in the "piston motion".

BRIEF SUMMARY OF THE INVENTION

The purpose of the present invention is to provide a putter that, when used in conjunction with a non-traditional stroke which is similar to the linear motion of a piston, will provide its user with superior precision and accuracy of motion.

It is an object of the present invention to provide a golf putter comprising a club head which is specially designed with a plurality of line markings to facilitate aiming at a target.

It is another object of the present invention to provide a golf putter which is specially designed with a plurality of line markings to facilitate an accurate strike of a golf ball.

It is another object of the present invention to provide a golf putter which is specially designed with a plurality of line markings to facilitate reproduction of a non-traditional stroke which is similar to the motion of a piston.

It is another object of the present invention to provide a golf putter which is specially designed with a detachable aiming plate that will extend the line markings on the golf putter.

It is another object of the present invention to provide a golf putter which is specially designed with a plurality of line markings that can correspond to line markings on a surface below the putter for the purpose of matching the club head's trajectory It is another object of the present invention to provide a golf putter whose aforementioned features may also provide guidance and assistance to a more traditional "pendulum swing".

BRIEF DESCRIPTION OF THE DRAWINGS

The present invention can be more easily understood and the advantages and uses thereof more readily apparent when the following detailed description of the present invention is read in conjunction with the figures, wherein.

In accordance to common practice, the various described features are not drawn to scale (unless denoted otherwise), but are drawn to emphasize specific features relevant to the invention. Like reference characters denote like elements throughout the figures and text.

DETAILED DESCRIPTION OF THE INVENTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure of method of the invention, but only to provide exemplary constructions. The embodiments are permissive rather than mandatory and illustrative rather than exhaustive.

Figure 1:
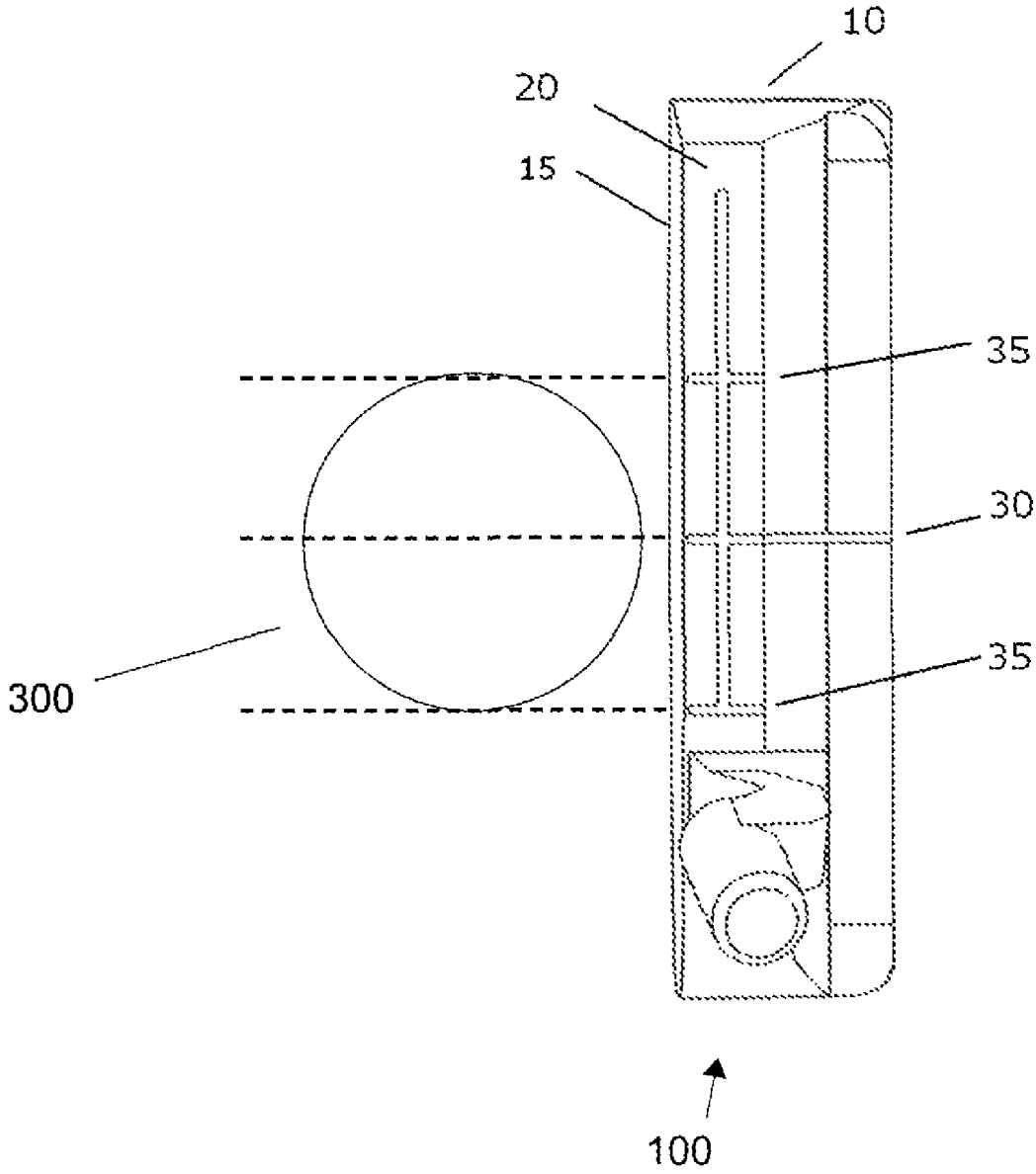
FIG. 1 depicts a golf putter with a plurality of line markings on its head.

FIG. 1 illustrates a golf putter 100 designed for training a golf player in practicing an unconventional style of stroke similar to the motion of a piston. The putter 100 has a club head 10 to be fixed to a shaft. The club head 10 has a plurality of lines affixed or marked on the top of the club head 10.

The guide lines comprise an aiming line 20, a center line 30, and a plurality of guide lines 35 (two in this embodiment). The aiming line 20 runs parallel to the face 15 of the club. The center line 30 is perpendicular to the aiming line and is positioned at the point the central axis of the golf ball 300 is intended to strike the face 15. In this embodiment, the two guide lines 35, when extended into space, are tangent to the golf ball.

Other embodiments can have additional numbers of guide lines 35, or no guide lines 35 and/or no center line 30 without altering the scope of the invention.

If the golfer is using the "piston stroke" method of putting, which follows a linear path, the golfer will be able to use the aiming line 20 to aim his stroke in the manner similar to a firearm. The putter is then drawn back along the intended path of the stroke, where the club head 10 is rotated 90 degrees. The golfer then uses the center line 30 and guide lines 35 to guide the path of his stroke back to the ball.

Figure 2:
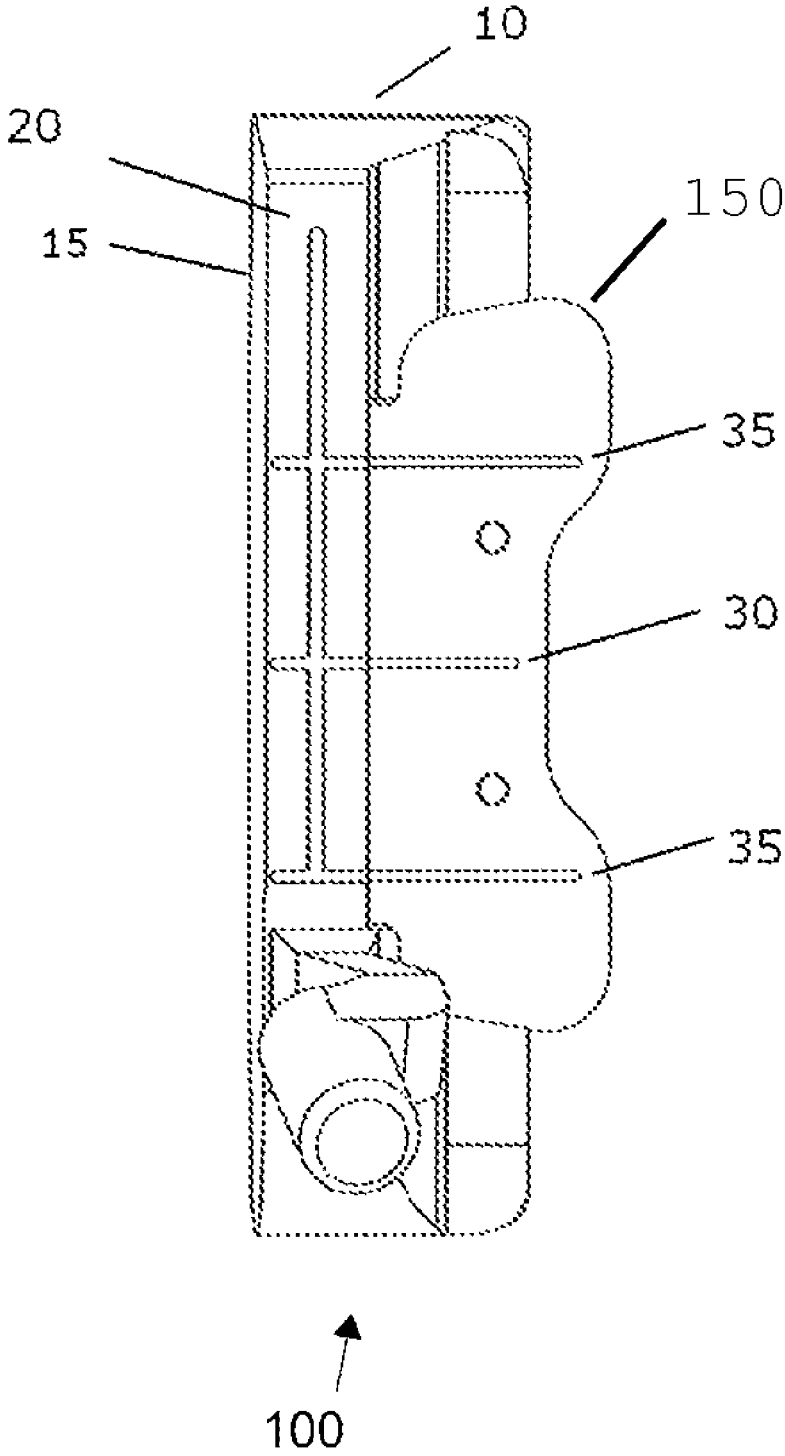
FIG. 2 depicts a golf putter with a plurality of line markings on its head with an aiming plate that extends the length of the line markings.

FIG. 2 illustrates a golf putter 100 with a plate 150 attached to the club head 10 that extends the center line 30 and guide lines 35 in order for better visualization of the lines.

In another embodiment, the plate 150 is detachable from the club head 10.

Figure 3:
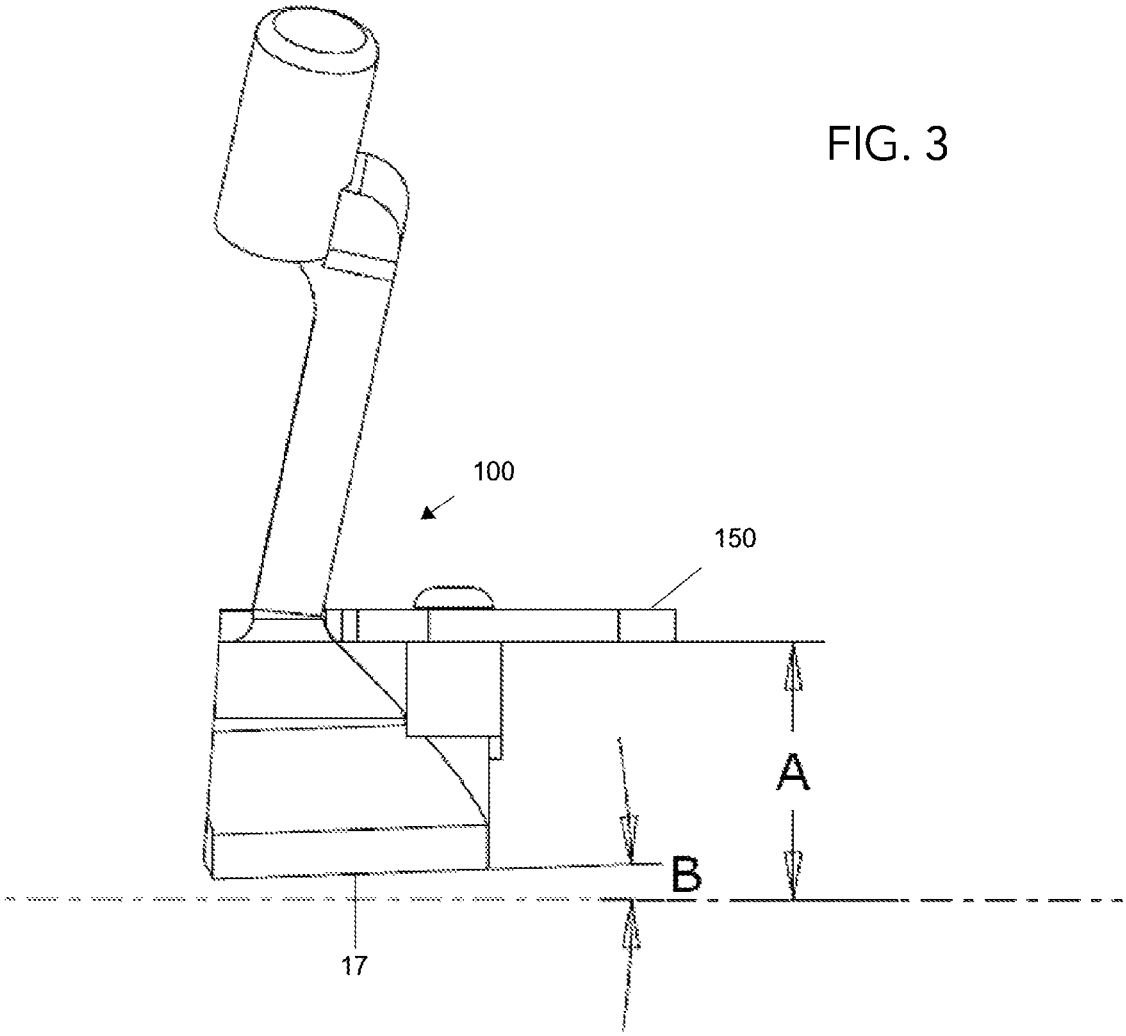
FIG. 3 depicts a golf putter with the aforesaid attachment in profile.

FIG. 3 illustrates plate height A (the distance between the shoe 17 of the club head 10 and the horizontal axis), shoe angle B (the angle between the shoe 17 of the club head 10 and the horizontal axis). These angles have been modified so as to facilitate the piston-like motion of the putter 100.

In this embodiment, when the putter 100 is in contact with a golf ball 300 (not shown), plate height A is 1 inch and the shoe angle B is (−) 2 degree. Other embodiments may vary plate height A and shoe angle B without altering the scope of the invention.

What is claimed is:

1. A putter comprising:

a club head including a club face, a top surface, and a bottom surface;

a plurality of line markings on the top surface including outermost line markings and a center line marking extending in a direction perpendicular to the club face; and a plate disposed adjacent the club head and detachable from the club head, the plate including a top surface having corresponding line markings in alignment with the outermost line markings and the center line marking on the top surface of the club head, wherein the top surface of the plate and the top surface of the club head are substantially coplanar, wherein the plate and the corresponding outermost line markings on the top surface of the plate extend beyond a width of the club head bottom surface, and wherein the outermost line markings on the top surface of the plate are of equal length and are longer than the center line marking.

2. The putter according to claim 1, wherein said club head is designed with a heel angle to facilitate a linear motion when swinging the putter.

3. A putter comprising:

a club head including a club face, a top surface, and a bottom surface;

a plurality of line markings on the top surface including outermost line markings and a center line marking extending in a direction perpendicular to the club face; and a plate disposed adjacent the club head and detachable from the club head, the plate including a top surface having corresponding line markings in alignment with the outermost line markings and the center line marking on the top surface of the club head, wherein the top surface of the plate and the top surface of the club head are substantially coplanar, wherein the plate and the corresponding outermost line markings on the top surface of the plate extend beyond a width of the club head bottom surface, and wherein one of the line markings on said top surface of club head runs parallel to the face and extends between and beyond a width of the outermost line markings on the top surface of the club head.

4. A putter comprising:

a club head;

a plurality of line markings on a top surface of the club head, comprising three line markings running perpendicular to the club face, the three line markings including outermost line markings and a center line marking; and a plate disposed adjacent the club head and detachable from the club head, the plate including a top surface having three line markings in alignment with the three line markings on the top surface of the club head, wherein the top surface of the plate and the top surface of the club head are substantially coplanar, wherein the plate and the corresponding outermost line markings on the top surface of the plate extend beyond a width of a club head bottom surface, and wherein the outermost line markings on the top surface of the plate are of equal length and are longer than the center line marking.

5. The putter according to claim 4, wherein said club head is designed with a heel angle to facilitate a linear motion when swinging the putter.

* * * * *